US006702291B2

(12) United States Patent
Grebler et al.

(10) Patent No.: US 6,702,291 B2
(45) **Date of Patent: *Mar. 9, 2004**

(54) STACKING BLOCK GAME

(75) Inventors: Robert Grebler, Santa Monica, CA (US); Paul Eveloff, San Anselmo, CA (US)

(73) Assignee: Pokonobe Associates, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/189,539

(22) Filed: Jul. 8, 2002

(65) Prior Publication Data

US 2003/0006554 A1 Jan. 9, 2003

Related U.S. Application Data

(63) Continuation of application No. PCT/US01/00506, filed on Jan. 8, 2001.

(60) Provisional application No. 60/174,804, filed on Jan. 7, 2000.

(51) Int. Cl.[7] ..... A63F 1/00

(52) U.S. Cl. ..... 273/292; 273/293; 273/296; 273/241

(58) Field of Search ..... 273/292, 293, 273/450, 449, 241, 296

(56) References Cited

U.S. PATENT DOCUMENTS

| | | | | | |
|---|---|---|---|---|---|
| 3,827,160 | A | * | 8/1974 | Talbot et al. | 434/208 |
| 4,215,858 | A | * | 8/1980 | Olsen | 273/447 |
| 4,635,939 | A | * | 1/1987 | Makow | 273/296 |
| 5,375,846 | A | * | 12/1994 | Smith | 273/292 |
| 5,967,517 | A | * | 10/1999 | Villano | 273/292 |
| 6,022,026 | A | * | 2/2000 | Johnson, III | 273/450 |
| 6,161,832 | A | * | 12/2000 | Holahan et al. | 273/241 |

FOREIGN PATENT DOCUMENTS

| | | | | |
|---|---|---|---|---|
| DK | 0 247 515 | * | 12/1987 | A63F/9/00 |
| EP | 0 190 876 A2 | | 8/1986 | |
| EP | 0 247 515 A1 | | 12/1987 | |
| GB | 623107 | | 12/1947 | |
| GB | 623107 | * | 5/1949 | A63F/9/00 |
| GB | 2 130 105 A | * | 5/1984 | A63F/9/00 |
| GB | 0 190 876 | * | 8/1986 | A63F/9/00 |
| WO | WO 97/26961 | | 7/1997 | A63F/9/00 |

OTHER PUBLICATIONS

PCT—WO 97/26961 Irwin Toy Limited Jul. 31, 1997.*

* cited by examiner

*Primary Examiner*—Steven Wong
*Assistant Examiner*—Dolores R. Collins
(74) *Attorney, Agent, or Firm*—Katten Muchin Zavis Rosenman

(57) ABSTRACT

A stacking block game kit includes a set of game cards, a number of stackable game pieces, and a set of rules for discarding the game cards and for manipulating the game pieces. Each game card has a card point value and depicts a card indicia thereon. The game pieces are stackable in layers having a fixed maximum number of the game pieces. Game piece indicia are applied to the game pieces, with a portion of the game piece indicia being associated with the card indicia. The method of playing the stacking block game involves distributing game cards from the stacking block game kit into card hands amongst players of the game, and constructing a structure from the stackable game pieces. Game cards are then discarded from the card hands in accordance with the set of rules and an associated one of the game pieces, with the discarding step being repeated amongst the players until a predetermined terminating step is obtained. Once the terminated step is reached, an aggregate point value is determined for each player at least from the card point values of the game cards remaining in the player's card hand.

17 Claims, 7 Drawing Sheets

STACKING BLOCK GAME

This is a continuation application of application Ser. No. PCT/US01/00506, filed Jan. 8, 2001, incorporated herein by reference, which claims priority benefit of U.S. patent application Ser. No. 60/174,804, filed Jan. 7, 2000.

FIELD OF THE INVENTION

The present invention relates to a game which is played using a set of stackable game pieces. In particular, the present invention relates to a game which employs a set of game blocks which are manipulated in accordance with a set of rules.

BACKGROUND OF THE INVENTION

Games using stackable game pieces are well known. For instance, in U.S. Pat. No. 3,863,918, Kramer teaches a game in which players are provided with a set of game pieces of various shapes, and are required to stack the game pieces on top of each other in layers without causing the structure to collapse. Although such games may be suitable for young children, their simplicity would not maintain the interest of older children or adults.

Other games using stackable game pieces have been developed having a greater level of difficulty than the traditional stacking piece game. In one such game, marketed under the trade-mark JENGA, a tower is constructed from a set of game blocks of generally elongate parallelepiped shape, with the blocks in each layer being perpendicular to the blocks in the layer above and the layer below. Players are required to remove a block from the tower and place it on the uppermost layer without toppling the tower. The ability to strategically select game blocks from the tower increases the level of difficulty of the game.

More recently, a game marketed under the trade-mark JENGA JACKS was developed having an even greater level of difficulty than JENGA. The game is played in a manner similar to JENGA, but employs of set of elongate parallelepiped game blocks having a pair of indicia on their respective ends. As in JENGA, players take turns removing a game block from the tower, and placing it on the uppermost layer of the tower without toppling the tower. However, unlike JENGA, players must select a game block from the tower for removal which, when positioned on the uppermost layer of the tower, has an indicia which matches an indicia on an adjacent block. By so limiting the number of blocks which can be removed, the level of difficulty of the game is increased.

Although JENGA and JENGA JACKS have been commercially successful, it is desirable to provide a stacking game using stackable game pieces which produces an even greater level of difficulty.

SUMMARY OF THE INVENTION

According to the invention, there is provided a stacking block game kit and a method of playing a stacking block game which addresses deficiencies of the prior art.

The stacking block game kit includes a set of game cards, a plurality of stackable game pieces, and a set of rules for discarding the game cards and for manipulating the game pieces. Each game card has a card point value and depicts a card indicia thereon. The game pieces are stackable in layers comprising a fixed maximum number of the game pieces. Each game piece has a length and a width, with the width being a portion of the length and the portion being a reciprocal of the maximum number of game pieces in a layer. Game piece indicia are applied to the game pieces, with a portion of the game piece indicia being associated with the card indicia.

The method of playing the stacking block game involves distributing game cards from the stacking block game kit into card hands amongst players of the game, with each said game card having a card point value and depicting a card indicia thereon, and also constructing a structure from the stacking block game kit comprising layers of stackable game pieces, with a portion of the game pieces including game piece indicia associated with the card indicia. Game cards are then discarded from the card hands in accordance with a set of rules and an associated one of the game pieces, with the discarding step being repeated amongst the players until a predetermined terminating step is obtained. Once the terminated step is reached, an aggregate point value is determined for each player at least from the card point values of the game cards remaining in the player's card hand.

In the preferred embodiment of the invention, the game card indicia and the game piece indicia comprise a playing card suit and a playing card rank. The game pieces comprise elongate bricks having a parallelopiped shape with a pair of opposite ends and a plurality of faces extending between the opposite ends, and the game piece indicia are disposed on the ends and the faces.

The set of rules require that if a game piece located in the structure below an uppermost one of the layers has a game piece indicia which corresponds with the card indicia of a game card held by one of the players, the player must remove the game piece from the structure, return the removed game piece to the uppermost layer of the structure, and then discard the corresponding game card from the player's card hand. If the player cannot remove a game piece which has a game piece indicia corresponding with the card indicia of a game card held by the player, the player may remove any other game piece and the player who has a game card whose card indicia corresponds with the removed game piece may discard the corresponding game card. Preferably, the game continues until a player causes the structure to collapse, whereupon a penalty value is added to the aggregate point value of the collapsing player.

The stacking block game kit and associated method of game play is advantageous since it allows a playing player to tactically select the game pieces for removal so as to prevent the other players from being able to deduce the playing players game cards. As a result, the level of difficulty possible with the stacking block game kit and method of game play is greater than prior art stacking block games.

BRIEF DESCRIPTION OF THE DRAWINGS

The preferred embodiment of the invention will now be described, by way of example only, with reference to the drawings, in which.

DETAILED DESCRIPTION OF THE PREFERRED EMBODIMENTS

Figure 1:
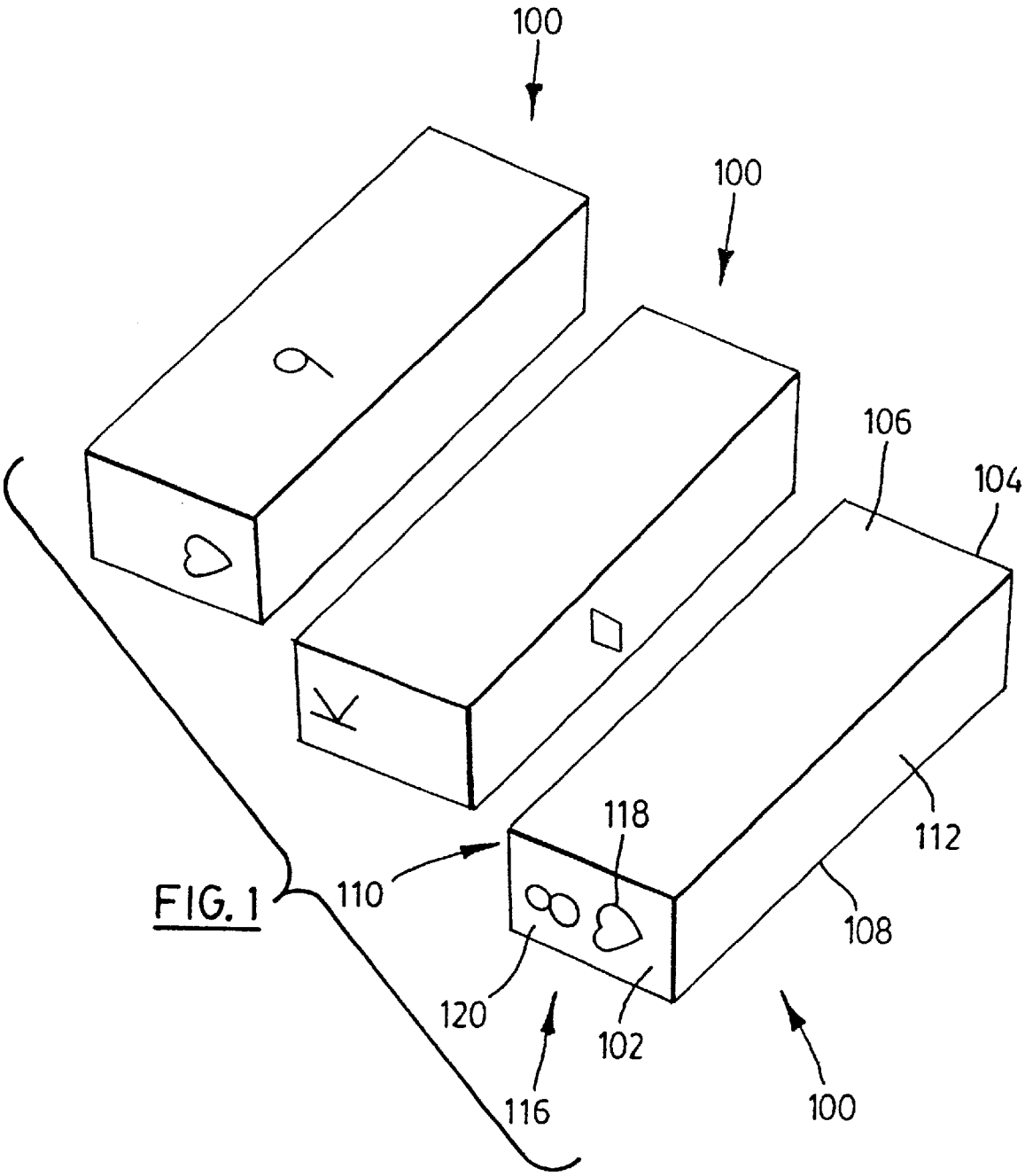
FIG. 1 is a perspective view of several stackable game pieces of the stacking block game kit.
Figure 2A:
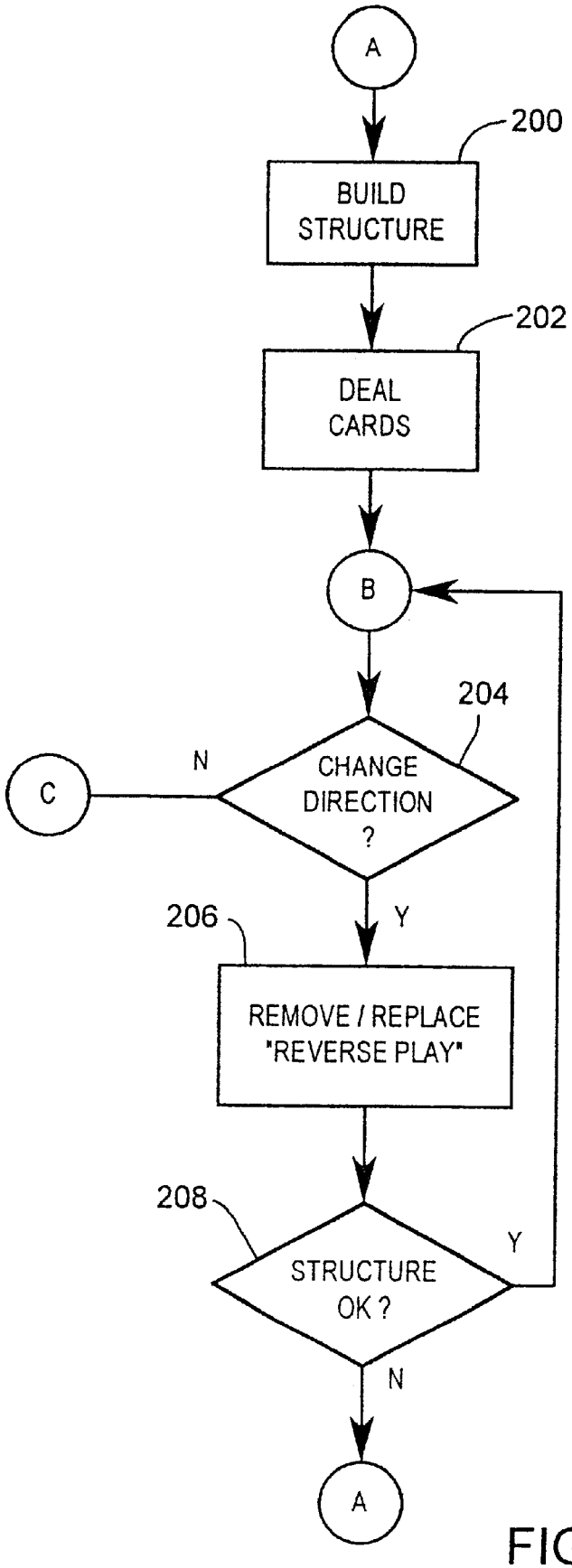
FIGS. 2*a* to 2*d* comprise a flowchart depicting the method of playing the stacking block game using the game pieces and game cards of the stacking block game kit.
Figure 2B:
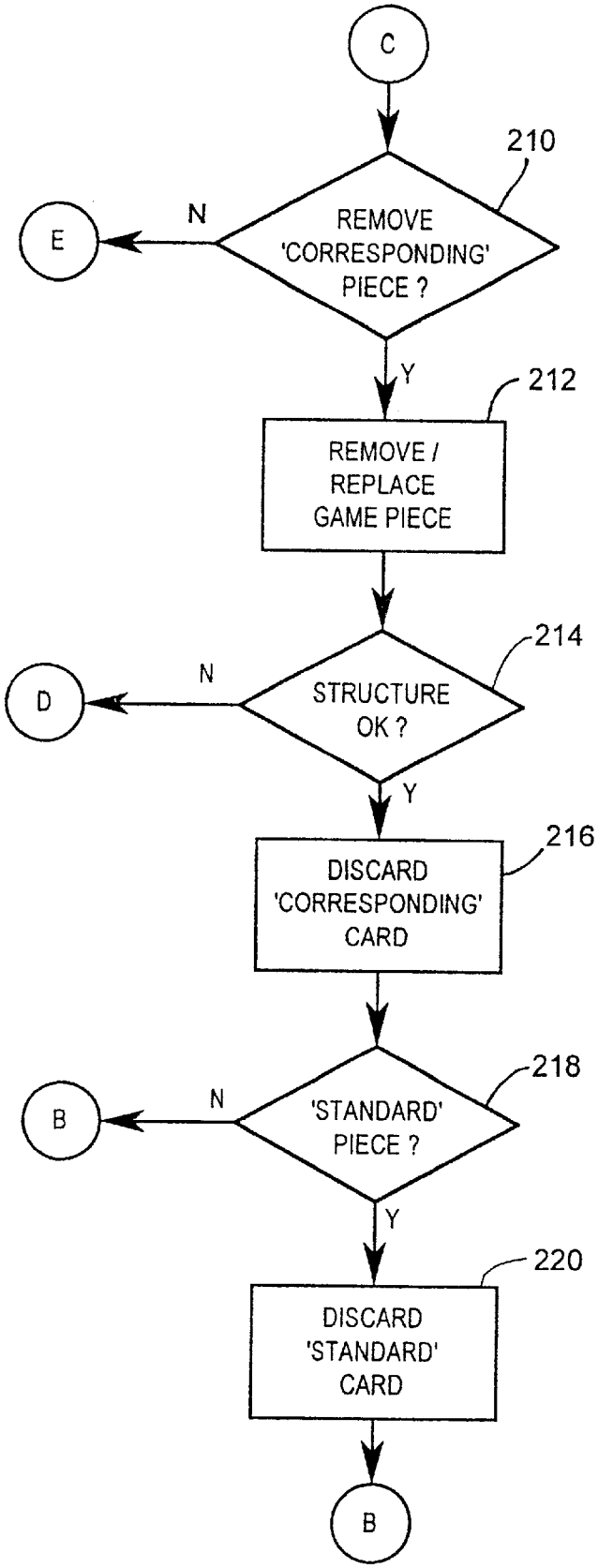
Figure 2C:
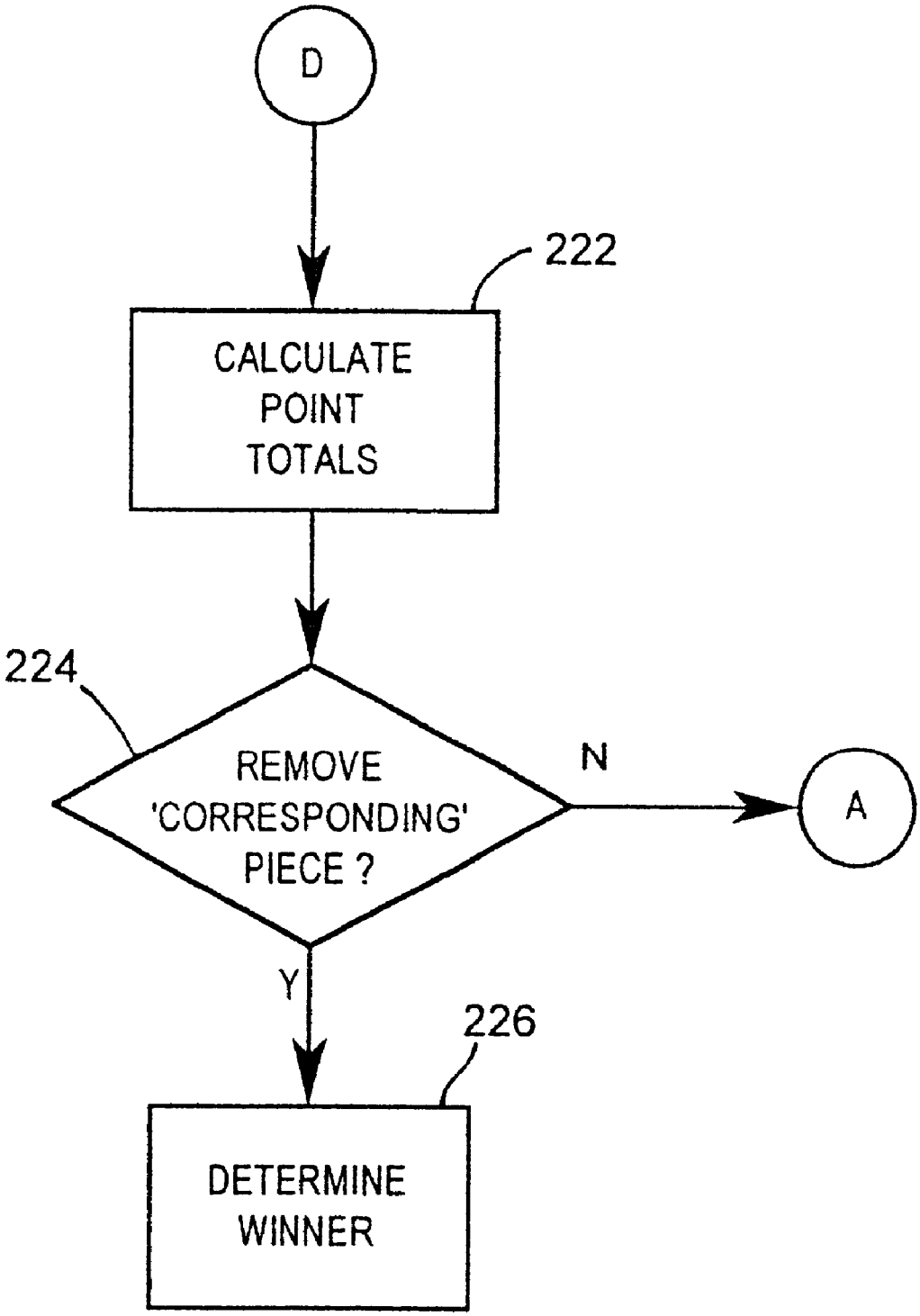
Figure 2D:
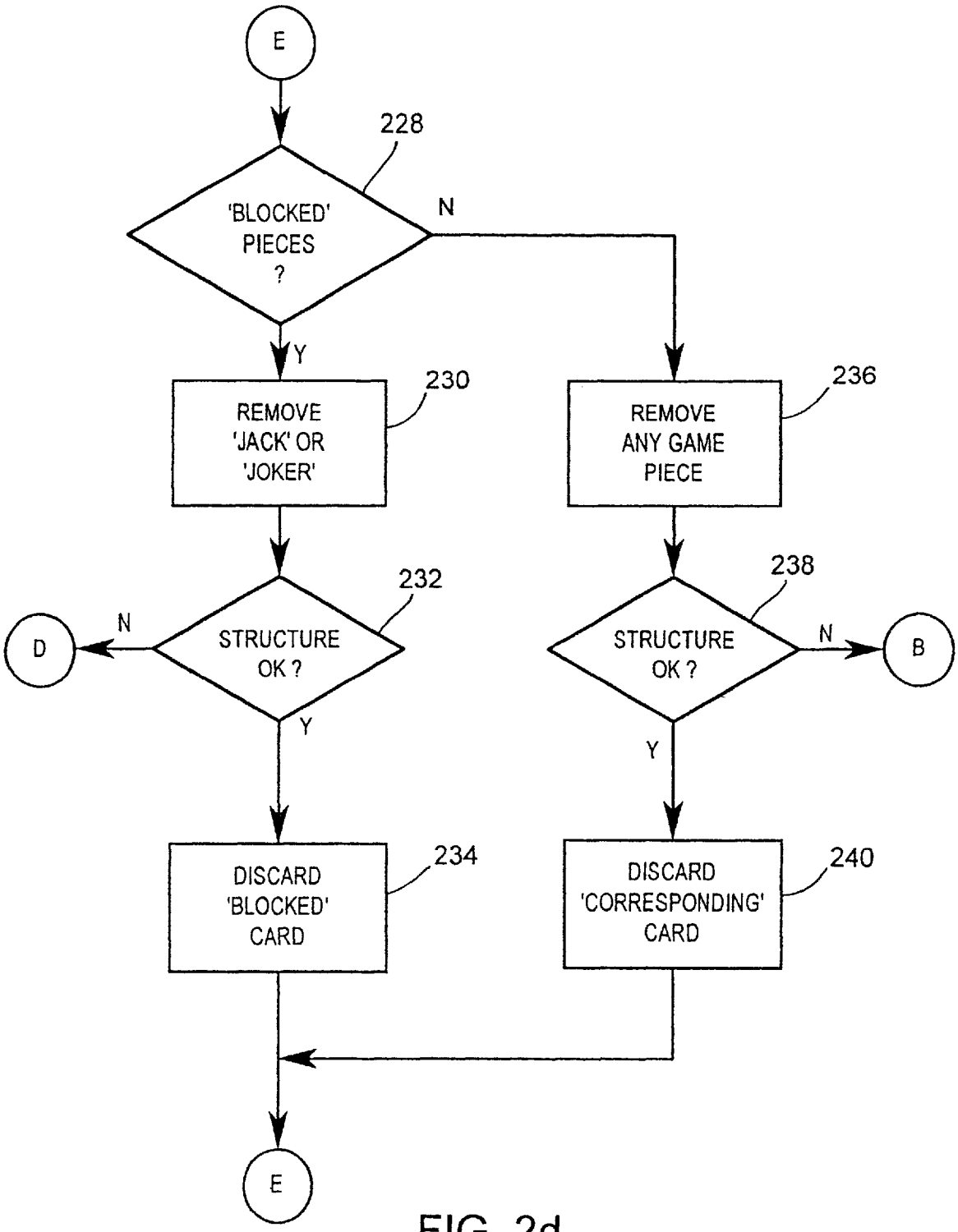

Turning to FIG. 1, a game piece 100 of the stacking block game kit, according to the present invention, is shown comprising an elongate parallelopiped-shaped block having opposed planar ends 102, 104, opposed planar faces 106, 108, and opposed planar sides 110, 112. Preferably, the width of each game piece 100 is 1/"N" of the length of the game piece 100, where "N" is an integer. However, it should be understood that the invention is not so limited, but may instead include interlocking blocks or any other game piece capable of being arranged to form a collapsible structure.

Each end 102, 104 of the game pieces 100 has indicia 116 applied thereto. Preferably, the indicia 116 is printed on self-adhesive paper, cut to fit on the ends 102, 104 and then applied to the ends 102, 104. Alternately, the indicia 116 may be engraved or stamped onto the ends 102, 104. Further, the indicia 116 may be provided on the faces 106, 108 or the sides 110, 112 provided that the indicia 116 are visible when from the assembled structure 200 (described below).

Preferably, the indicia 116 comprises a suit symbol 118 selected from the group of Hearts, Spades, Diamonds and Clubs, and an alphanumeric symbol 120 selected from the group comprising 2, 3, 4, 5, 6, 7, 8, 9, 10, J, Q, K, A. Additionally, other game pieces 100 may depict "wild card" indicia, including a "Joker" indicia, and a "Reverse Play" indicia. However, the invention, is not limited to the described symbol sets, but may comprise any other suitable symbols sets. Further, the indicia may comprise a single symbol set, or more than two symbol sets, if desired.

Figure 3:
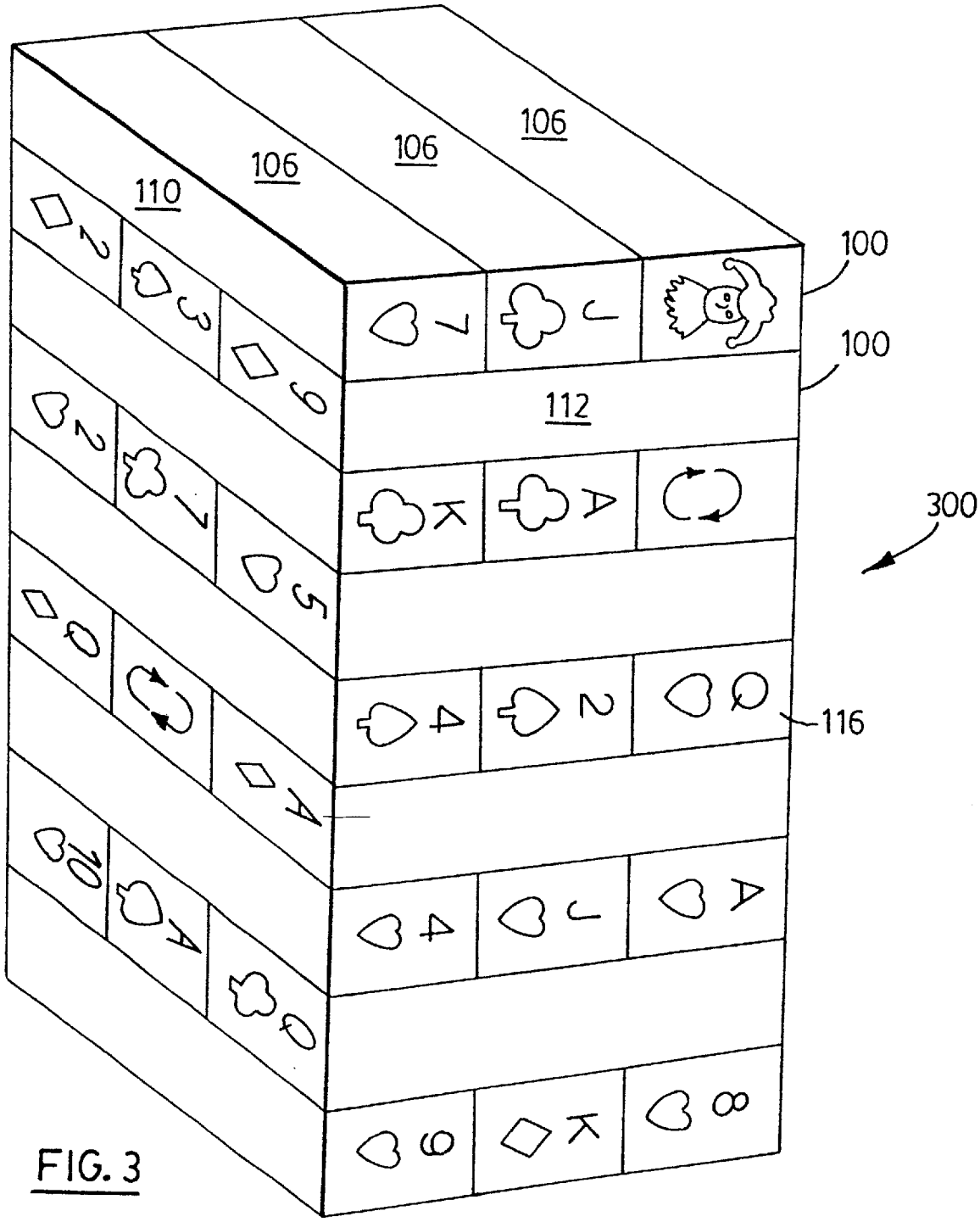
FIG. 3 is a perspective view of a tower comprising layers of the game pieces shown in FIG. 1.

The method of playing the stacking block game using the stacking block game kit will now be described with reference to FIGS. 2*a* to 2*d*. At step 200, the game pieces 100 are arranged substantially parallel to one another in layers of "N" game pieces 100 to form a tower-shaped structure 300 of stacked game pieces 100, as shown in FIG. 3. As shown, preferably the width of each game piece 100 is ⅓ the length, and the game pieces 100 are arranged in the tower-shaped structure 300 in layers of three game pieces 100 per layer. Further, preferably the game pieces 100 are distributed randomly throughout the structure 300, the game pieces 100 in each layer are oriented at a right angle relative to the game pieces 100 in the layers immediately adjacent, and are laid on their faces 106, 108 to provide a stable structure 300. However, it will be appreciated that some or all of the game pieces 100 may be laid on their sides 110, 112, if desired. Further, the game pieces 100 need not be arranged to form a tower-shaped structure 300. Rather, if the game pieces 100 comprise interlocking game pieces, for instance, the game pieces 100 may be arranged to form an alternate structure, such as a bridge.

Figure 4:
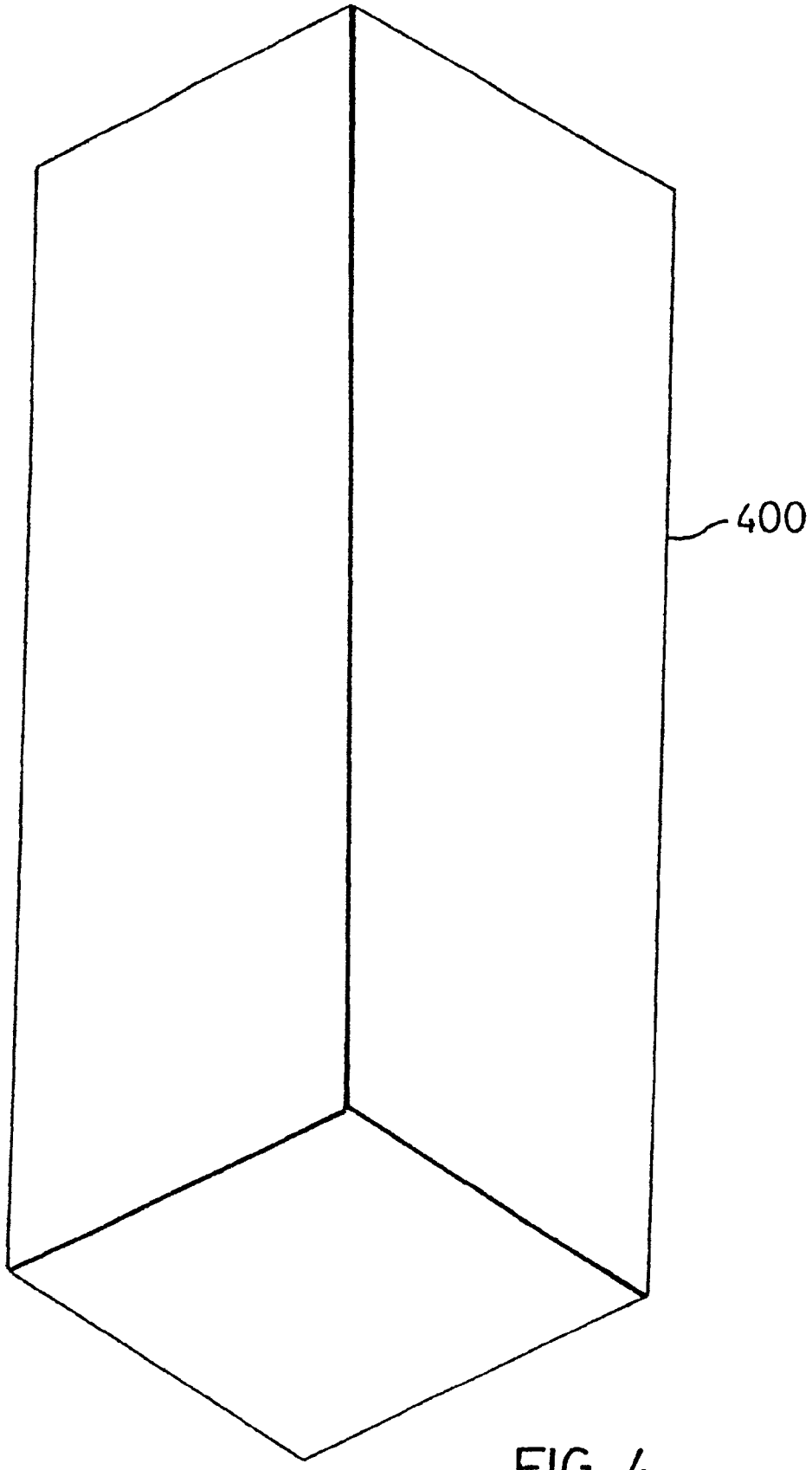
FIG. 4 is a game piece loading tray used to form the tower shown in FIG. 3.

To facilitate forming the tower-shaped structure 300, a loading tray, such as the loading tray 400 shown in FIG. 4, may be used to hold the game pieces 100 in place until the structure 300 is completed. When the structure 300 is completed, the loading tray 400 may then be removed leaving the structure 300 in tact.

After the game pieces 100 are arranged into the desired structure 300 (or concurrently with the construction of the structure 300), one of the players is elected to deal to the other players game cards from a deck of playing cards (not shown) from the stacking block game kit. The dealer maybe elected on the basis of the relative ages of the players, on the basis of a roll of a die, or some other suitable basis known to those skilled in the art.

The game cards each have a point value, and include indicia which correspond to the indicia 116 depicted on the game pieces 100. Preferably, the game cards and the game pieces 100 include indicia which comprises a suit symbol selected from the group of Hearts, Spades, Diamonds and Clubs, and an alphanumeric symbol selected from the group comprising 2, 3, 4, 5, 6, 7, 8, 9, 10, J, Q, K, A. If the game cards include the aforementioned game card indicia, preferably point values are assigned to each of the game cards 100 as follows:

| | |
|---|---|
| 2, 3, 4, 5, 6, 7, 8, 9 or 10: | face value |
| J, Q, or K: | 10 points |
| A: | 15 points |

If the game piece indicia 116 comprises symbol sets which are different than that described above, preferably the playing cards include indicia which match the indicia 116 depicted on the game pieces 100, but do not include "wild card" indica. However, for added versatility, the game cards may include "wild card" indicia, if desired.

Further, the indicia on the game cards need not be identical to the indicia 116 on the game pieces 100. Rather, another correspondence between game card indicia and game piece indicia 116 may be agreed upon by the players. Further, there need not be a 1:1 correspondence between game card indicia and game piece indicia 116. Instead, a game piece indicia 116 may correspond to the indicia of more than one game cards, as the players may agree.

Once the dealer is selected, the players agree upon a terminating event for the game, such as a maximum time period for the game or a maximum number of rounds that will be played. The dealer then shuffles the game cards and, at step 202, deals out the game cards into card hands, face down, to the players. It does not matter if one of the players has more cards than another of the players.

After the game cards are dealt, each player picks up his/her card hand, and looks at the game cards without revealing the game cards to the other players. Preferably, the player to the left of the dealer plays (ie. has a "turn") first, following in either a counterclockwise or clockwise sequence through the remaining players. However, the sequence of play may also be altered by a "Reverse Play" game piece, as discussed below.

At step 204, the "playing" player (ie. the player having a "turn") decides whether to change the sequence of play amongst the players. If the playing player decides to change the sequence of play, the player must remove from the structure 300, below the uppermost layer of the structure 300, a game piece 100 which bears a "Reverse Play" indicia. If the structure 300 contains such a game piece 100, and it can be removed from the structure 300 without causing the structure 300 to collapse, at step 206 the playing player removes the game piece 100 from the structure 300 using only a single hand, and then using the same hand places the removed game piece 100 on the uppermost layer of the structure 300.

If the uppermost layer already has the maximum number "N" of game pieces 100, the playing player places the removed game piece 100 above the upper most layer, thereby creating a new uppermost layer. In either case, preferably the playing player places the removed game piece 100 in the uppermost layer at a right angle to the game pieces 100 in the layer immediately below the uppermost layer, and substantially parallel to the other game pieces 100 in the uppermost layer.

At step 208, a determination is made whether the playing player successfully replaced the removed game piece 100 in the structure 300 without causing the structure 300 to collapse. If the playing player is successful, play then continues in sequence amongst the players in the opposite direction to the direction of play prior to the removal of the "Reverse Play" game piece 100. Thus, for example, if the sequence of play amongst the players had a counterclockwise direction, then the sequence of play would have a clockwise direction after the removal of the "Reverse Play" game piece 100. However, if the playing player causes the structure 300 to collapse when replacing the removed game piece 100, the point totals for all the players are calculated, and a winner is determined if the terminating event was reached. This aspect of the method will be described in detail below.

If at step 204, the playing player chooses not to change the sequence of play, at step 210 the playing player scans the structure 300 to determine if one of the game pieces 100 in the structure 300, below the uppermost layer of the structure 300, has an indicia 116 which "corresponds" to the indicia of one of the game cards in the player's card hand. As used herein, typically a game card will "correspond" with a game piece 100 if the game card indicia is identical to the game piece indicia 116. Additionally, a game piece 100 having a "Joker" game piece indicia 116 will "correspond" to any game card in the player's card hand. Alternately, as discussed above, the players may agree upon another game card—game piece correspondence scheme.

If a game piece 100 located in the structure 300 below the uppermost layer of the structure 300 has an indicia 116 which "corresponds" to the indicia of one of the game cards in the player's card hand, and can be removed from the structure 300 without causing the structure 300 to collapse, and the playing player decides to remove the game piece 100 from the structure 300, at step 212 the playing player removes the game piece 100 from the structure 300 using only a single hand, and then using the same hand places the removed game piece 100 on the uppermost layer of the structure 300.

As discussed above, if the uppermost layer already has the maximum number "N" of game pieces 100, the playing player places the removed game piece 100 above the upper most layer, thereby creating a new uppermost layer. In either case, preferably the playing player places the removed game piece 100 in the uppermost layer at a right angle to the game pieces 100 in the layer immediately below the uppermost layer, and substantially parallel to the other game pieces 100 in the uppermost layer.

At step 214, a determination is then made whether the playing player successfully replaced the removed game piece 100 in the structure 300 without causing the structure 300 to collapse. If the playing player causes the structure 300 to collapse when replacing the removed game piece 100, the point totals for all the players are calculated, and a winner is determined if the terminating event was reached. However, if the playing player successfully returned the removed game piece 100 to the structure 300, at step 216 the playing player discards from his/her card hand the game card which matches the removed/replaced game piece 100. The playing player then determines, at step 218, whether the structure 300 has a layer containing only a single game piece 100. If the single game piece 100 cannot be removed without collapsing the structure 300 (ie. the game piece 100 is "stranded"), and the indicia 116 on the stranded game piece 100 corresponds to the indicia of one of the game cards in the playing player's card hand, at step 220 the playing player may then discard from his/her card hand the game card which corresponds to the stranded game piece 100.

Play then continues in sequence amongst the players until one of the playing players causes the structure 300 to collapse when placing the removed game piece 100 on the uppermost layer of the structure 300. If one of the players cause the structure 300 to collapse, at step 222 the total of the number of points for the game cards remaining in each player's respective card hand is determined. Preferably, a penalty value of 20 points is added to the point total of the card hand of the playing player which caused the structure 300 to collapse. At step 224, a determination is then made whether the terminating event has been reached. If the terminating event has not been reached, play continues at step 200 with the building of a new structure 300. The new structure 300 may have the same configuration as the previous structure 300, or may have an entirely different configuration. On the other hand, if the terminating event is reached, at step 226 preferably the player having the lowest score, after all the rounds are played, is proclaimed to be the winner.

If, at step 210, the playing player does not remove a "corresponding" game piece 100 from the structure 300, then at step 228 the playing player determines whether one of the layers of the structure 300, below the uppermost layer of the structure 300, contains only two game pieces, which are located at opposite ends of their respective layer, and which are "blocked" from removal in the sense that neither of the game pieces 100 can be removed from the structure 300 without causing the structure 300 to collapse. If the structure 300 contains a layer of two such "blocked" game pieces 100, then the game cards corresponding to the "blocked" game pieces 100 cannot be discarded unless the playing player removes (and successfully replaces) a "Joker" or a "Jack" game piece 100 from the structure 300.

Accordingly, if the playing player locates a layer of two "blocked" game pieces 100, and the structure 300 contains either a "Joker" or a "Jack" game piece 100 below the uppermost layer of the structure 300, the playing player may discard the game cards corresponding to the "blocked" game pieces 100 by first removing at step 230 either the "Joker" or "Jack" game piece 100 from the structure 300 using only a single hand, and using the same hand placing the removed game piece 100 on the uppermost layer of the structure 300. As discussed above, if the uppermost layer already has the maximum number "N" of game pieces 100, the playing player places the removed "Joker" or "Jack" game piece 100 above the upper most layer, thereby creating a new uppermost layer.

At step 232, a determination is then made whether the playing player successfully replaced the removed "Joker" or "Jack" game piece 100 in the structure 300 without causing the structure 300 to collapse. If the playing player causes the structure 300 to collapse when replacing the removed "Joker" or "Jack" game piece 100, the point totals for all the players are calculated, and a winner is determined if the terminating event was reached, as discussed above. However, if the playing player successfully returned the removed "Joker" or "Jack" game piece 100 to the structure 300, at step 234 the playing player discards from his/her card hand a game card which corresponds to one of the "blocked" game pieces 100.

If, at step 228, the playing player does not locate any "blocked", "Joker" or "Jack" game pieces 100 (or chooses not to remove a "Joker" or "Jack" game piece 100), then at step 236 using only a single hand the playing player removes from the structure 300 below the uppermost layer any game piece 100 not corresponding to a game card in the playing player's card hand. The playing player then returns, using the same hand, the removed game piece 100 to the uppermost layer of the structure 300. As discussed above, if the uppermost layer already has the maximum number "N" of game pieces 100, the playing player places the removed game piece 100 above the upper most layer, thereby creating a new uppermost layer.

At step 238, a determination is then made whether the playing player successfully replaced the removed game piece 100 in the structure 300 without causing the structure 300 to collapse. If the playing player causes the structure 300 to collapse when replacing the removed game piece 100, the point totals for all the players are calculated, and a winner is determined if the terminating event was reached. However, if the playing player successfully returns the removed game piece 100 to the structure 300, if the indicia 116 of the removed game piece 100 corresponds with the indicia of one of the game cards in another player's card hand, at step 240 this other player may then immediately discard from his/her card hand (without waiting for his/her "turn") the game card which corresponds with the removed/replaced game piece 100. Play then continues in sequence amongst the player until the terminating event is reached, as described above.

The present invention is defined by the claims appended hereto, with the foregoing description being illustrative of a preferred embodiment of the invention. Those of ordinary skill may envisage certain additions, deletions and/or modifications to the described embodiment which, although not explicitly described or suggested herein, do not depart from the spirit or scope of the present invention, as defined by the appended claims.

We claim:

1. A stacking block kit, comprising a set of game cards each having a card point value and depicting a card indicia thereon;

a plurality of game pieces stackable in layers comprising a fixed maximum number of said game pieces, each said game piece having a length and a width, said width being a portion of said length, said portion being a reciprocal of said maximum number, and game piece indicia applied to the game piece, a portion of the game piece indicia being associated with the card indicia; and a set of rules for discarding the game cards and for manipulating the game pieces.

2. The kit according to claim 1, wherein the game pieces comprise elongate bricks having a parallelepiped shape, and the rules mandate that the bricks comprising one of the layers be substantially perpendicular to the bricks comprising an adjacent one of the layers.

3. The kit according to claim 2, wherein each said game piece include a pair of opposite ends and a plurality of faces extending between the opposite ends, and the game piece indicia are disposed on the ends and the faces.

4. The kit according to claim 3, wherein the game card indicia and the game piece indicia comprise a playing card suit and a playing card rank.

5. A method of playing a slacking block game comprising the steps of:

distributing game cards into card hands amongst players of the game, each said game card having a card point value and depicting a card indicia thereon, and constructing a structure comprising layers of stackable game pieces, a portion of the game pieces including game piece indicia associated with the card indicia;

discarding one of the game cards in accordance with a set of rules and an associated one of the game pieces;

repeating the discarding step amongst the players until a predetermined terminating step is obtained; and for each said player determining an aggregate point value at least from the card point values of the game cards remaining in the associated card hand.

6. The method according to claim 5, wherein the game piece indicia of the associated one game piece matches the card indicia of the one game card, the associated one game piece being located in the structure below an uppermost one of the layers, and the set of rules comprises the steps of removing the located game piece from the structure, returning the removed game piece to the uppermost layer of the structure, and discarding the matching game card from the card hand of one of the players.

7. The method according to claim 6, wherein the removing step comprises one of the players removing the located game piece from the structure, and the discarding step comprises one of the players discarding the matching game card, the removing one player being different from the discarding one player.

8. The method according to claim 7, wherein the predetermined terminating step comprises a collapse of the structure, and the point value determining step comprises adding a penalty value to the aggregate point value of the removing one player for collapsing the structure.

9. The method according to claim 5, wherein the stacking block indicia of the associated one stacking block matches the card indicia of the one game card, the associated one stacking block being located in the structure below an uppermost one of the layers, and the associated one stacking block cannot be removed without collapsing the structure, and the set of rules comprises discarding the matching game card from the card hand of one of the players upon a turn of the one player.

10. The method according to claim 9, wherein the unremovable game piece is located in a central position within one of the layers, the one layer including only the movable game piece.

11. The method according to claim 5, wherein the associated one game piece cannot be removed without collapsing the structure, the unremovable game piece being located in an and position within one of the layers, and the set of rules comprises discarding the game card associated with the unremovable game piece upon removal from the stricture of a specialty one of the game pieces.

12. The kit according to claim 1, wherein the set of rules require a distribution of the game cards into card hands amongst players of the game, and a construction of a structure comprising layers of the stacking blocks, the rules further require that subsequent to said construction the players in turn (1) select one of the stacking blocks for removal from the structure, and (2) discard from one of the card hands the game card associated with the selected stacking block.

13. The kit according to claim 12, wherein the stacking block indicia of the selected stacking block matches the card indicia of the associated game card, the selected stacking block being located in the structure below an uppermost one of the layers, and the discarding step comprises the steps of removing the selected stacking block from the structure, returning the removed stacking block to the uppermost layer of the structure, and removing the matching game card from the one card hand.

14. The kit according to claim 13, wherein the block removing step comprises one of the players removing the selected stacking block from the structure, and the card removing step comprises another one of the players discarding from its card hand the matching game card.

15. The kit according to claim 12, wherein the stacking block indicia of the selected stacking block matches the card indicia of the associated game card, the selected stacking block cannot be removed without collapsing the structure, and the discarding step comprises removing the matching game card from the card hand of one of the players upon a turn of the one player.

16. The kit according to claim 15, wherein the unremovable stacking block is located in a central position within one of the layers, the one layer including only the unremovable stacking block.

17. The kit according to claim 12, wherein the selected stacking block cannot be removed without collapsing the structure, the unremovable stacking block being located in an end position within one of the layers, and the discarding step comprises discarding the game card associated with the unremovable stacking block upon removal from the structure of a specialty one of the stacking blocks.

* * * * *